US005122221A

United States Patent [19]

Isowa et al.

[11] Patent Number: 5,122,221

[45] Date of Patent: Jun. 16, 1992

[54] SINGLE FACER SYSTEM CAPABLE OF DISPERSING VIBRATIONS CAUSED BY THE CORRUGATING ROLLS

[75] Inventors: Eiichi Isowa, Nagoya; Toshihiko Yasui, Owariasahi, both of Japan

[73] Assignee: Isowa Industry Company Ltd., Nagoya, Japan

[21] Appl. No.: 530,374

[22] Filed: May 30, 1990

[30] Foreign Application Priority Data

Jun. 5, 1989 [JP] Japan ..... 1-65596[U]

[51] Int. Cl.[5] ..... B31F 1/24

[52] U.S. Cl. ..... 156/472; 156/470; 156/471

[58] Field of Search ..... 156/205, 210, 462, 470, 156/471, 472; 493/463; 264/286

[56] References Cited

U.S. PATENT DOCUMENTS 3,671,361 6/1972 Morrison ..... 156/205 X
3,919,029 11/1975 Osgood ..... 156/205
4,531,996 7/1985 Sukenik ..... 156/472
4,814,038 3/1989 Hayashi et al. ..... 156/471

*Primary Examiner*—Michael W. Ball
*Assistant Examiner*—Michele K. Yoder
*Attorney, Agent, or Firm*—Schwartz & Weinrieb

[57] ABSTRACT

Disclosed is a single facer having a first fluted roll unit consisting of a pair of radially outer and radially inner rolls, a second fluted roll unit also consisting of a pair of similar radially outer and radially inner rolls, and a press roll, wherein the press roll is designed to be selectively operated in combination with either one of the two fluted roll units before the forming operation is started; characterized in that the first fluted roll unit is disposed at a predetermined angle with respect to a vertical plane above the press roll and the second fluted roll unit is disposed vertically below the press roll; and flutes formed upon the surfaces of the radially outer and radially inner rolls of the second fluted roll unit are designed to be smaller than the flutes formed upon the surfaces of the radially outer and radially inner rolls of the first fluted roll unit.

4 Claims, 5 Drawing Sheets

(a)

(b)

(a)

(b)

SINGLE FACER SYSTEM CAPABLE OF DISPERSING VIBRATIONS CAUSED BY THE CORRUGATING ROLLS

FIELD OF THE INVENTION

This invention relates to a single facer within a corrugator system, that is, an apparatus for forming a single-faced corrugated board, which can selectively form a single-faced corrugated board by means of any one of several different types of corrugations or flutes incorporated within the apparatus or system.

BACKGROUND OF INVENTION

There is conventionally known single facer apparatus which forms a single-faced corrugated board by corrugating a sheet medium so as to have corrugations having a predetermined pitch size, and adhering a liner upon the crests of the corrugations by means of a suitable adhesive. The single facer comprises a radially outer fluted roll and a radially inner fluted roll both having a wavy set of flutes upon the circumferential portions thereof and rotatably supported upon a frame in such a manner that their fluted circumferences may be engaged in a vertical relationship, and a press roll which is designed to be brought into press contact with the radially inner fluted roll with the corrugating medium and liner interposed therebetween. The corrugated medium is formed with predetermined flutes or corrugations as it is fed between the radially outer fluted roll and the radially inner fluted roll as a result of the engagement of their fluted circumferences, and in addition glue is applied to the crests of the corrugations by means of a gluing roll provided within a gluing mechanism. The liner being fed from the opposite side of the corrugated medium with respect to the press roll is bonded to the crests of the corrugated medium being pressed against the radially inner fluted roll by means of the press roll as the corrugated medium passes between the radially inner fluted roll and the press roll so as to form a single-faced corrugated board.

Single-faced corrugated boards are generally classified into Flute A, Flute B, Flute C, Flute E, Nos. 4 and 5 Flutes, and the like, depending upon the depth of the flutes to be formed upon the corrugated medium and the standard number of crests per 30 cm. Such flute types can be selected depending upon the shapes of the fluted circumferences of the radially outer and radially inner fluted rolls to be disposed within the single facer.

As described above, there are many flute types within a single-faced corrugated board and the corrugation type is dependent upon the shape of the flutes formed upon the surface of the radially outer and radially inner fluted rolls incorporated within the single facer. Accordingly, in order to form different types of single-faced corrugated boards within one single facer, there has been employed a manufacturing system wherein a plurality of single facers are arranged along a corrugator line so as to enable selective shifting to the desired single facer.

In this case, however, the installation of a plurality of single facers involves various problems for practical applications including the installation area, workability and incidental equipment, while it is also known that the cost of the apparatus is substantially doubled. Moreover, the combination of the types of single-faced corrugated boards with different types of corrugations selectively made during the production is not random but predetermined for example, a combination of Flutes A and E, or Flutes B and E, or Flutes C and E, and the like. Then, various types of machines for making several kinds of single-faced corrugated boards with different types of corrugations are proposed, in which two pairs of fluted roll units each having fluted rolls with different types of flutes disposed within one single facer so as to form different types of single-faced corrugated boards are utilized.

For example, there is a preceding patent application filed by means of the present applicant and entitled: "Single facer", Japanese Provisional Patent Publication No. 58881/1986. In the apparatus according to such invention, as disclosed in the published drawings, the first fluted roll unit consisting of a pair of fluted rolls and the second fluted roll unit composed of a pair of fluted rolls are arranged diagonally above and below the press roll, respectively, which can selectively be used in conjunction with either one of the two fluted roll units, and the combination of either the press roll and the first fluted roll unit or the press roll and the second fluted roll unit is selected before operation of the apparatus so as to form the single-faced corrugated boards with a different form of corrugation.

In accordance with this system, when the combination of corrugated board sheets is to be changed by means of a different combination or selection of corrugating rolls or when the ordinary production of corrugated boards becomes impossible due to worn fluted rolls, all of the radially outer and radially inner rolls of the first and second fluted roll units must be replaced with other new rolls. In this case, the second fluted roll unit arranged beneath the first fluted roll unit was disposed along an inclined plane and below the gluing mechanism, so that the replacement work of its radially outer and radially inner rolls was very difficult requiring much labor and time. This has been a new problem to be solved.

OBJECT OF THE INVENTION

This invention has been proposed to solve the above-mentioned problems involved in the prior art single facers comprising, as mentioned above, a pair of corrugating units for producing a plurality of single-faced corrugated boards with different types of corrugations. In view of these problems, the object of this invention is to provide a single facer enabling the replacement of fluted rolls to be done more efficiently.

SUMMARY OF THE INVENTION

In order to solve the above problems and achieve the intended object more suitably, this invention provides a single facer having a first fluted roll unit consisting of a pair of radially outer and radially inner rolls, a second fluted roll unit also consisting of a pair of similar radially outer and radially inner rolls, and a press roll, wherein the press roll is designed to be operated selectively in combination with either one of the two fluted roll units before the forming operation is started; characterized in that the first fluted roll unit is disposed diagonally above the press roll and the second fluted roll unit is disposed vertically below the press roll; and the flutes formed upon the surface of the radially outer and radially inner rolls of the second fluted roll unit are designed to be smaller than the flutes formed upon the surface of the radially outer and radially inner rolls of the first fluted roll unit.

Thus, the single facer according to this invention can easily meet the need of producing a single-faced corrugated board with different types of corrugations or flutes. Compared with the conventional cases where a plurality of machines with the same constitution are arranged, however, the machine according to this invention only has the basic structure in which an additional set of radially outer and radially inner rolls are added to the conventional single facer. Therefore, the installation area required is only that for a single machine, which contributes to effective utilization of the installation space.

Furthermore, the fluted roll unit disposed below the press roll is arranged vertically below it, facilitating the replacement of the fluted rolls and shortening the replacement work time. Still further, the flutes formed upon the circumference of the rolls of the first fluted roll unit are larger than the flutes formed upon the circumference of the rolls of the second fluted roll unit, enabling it to effectively reduce the vibrations of the machine caused by means of the second fluted roll unit during operation. There is another advantage that the system can effectively prevent the corrugating medium from being broken.

BRIEF DESCRIPTION OF THE DRAWINGS

Various other objects, features, and attendant advantages of the present invention will become better understood from the following detailed description when considered in connection with the accompanying drawings, in which like reference characters designate like or corresponding parts throughout the several views, and wherein:

FIG. 2(*b*) shows the state of the single facer in FIG. 1 in which the second fluted roll unit is combined with the press roll so as to manufacture single-faced corrugated boards while the first fluted roll unit is on standby.

DESCRIPTION OF THE PREFERRED EMBODIMENT OF THE INVENTION

A preferred embodiment of the single facer constructed according to this invention will hereinafter be described referring to the accompanying drawings.

In this specification, the term of "the radially outer roll" and "the radially inner roll" does not indicate that the rolls are disposed in any spatial upper or lower position, but the term "radially inner roll" shall mean the roll pressed against the press roll with the liner and corrugating medium interposed therebetween.

Figure 1:
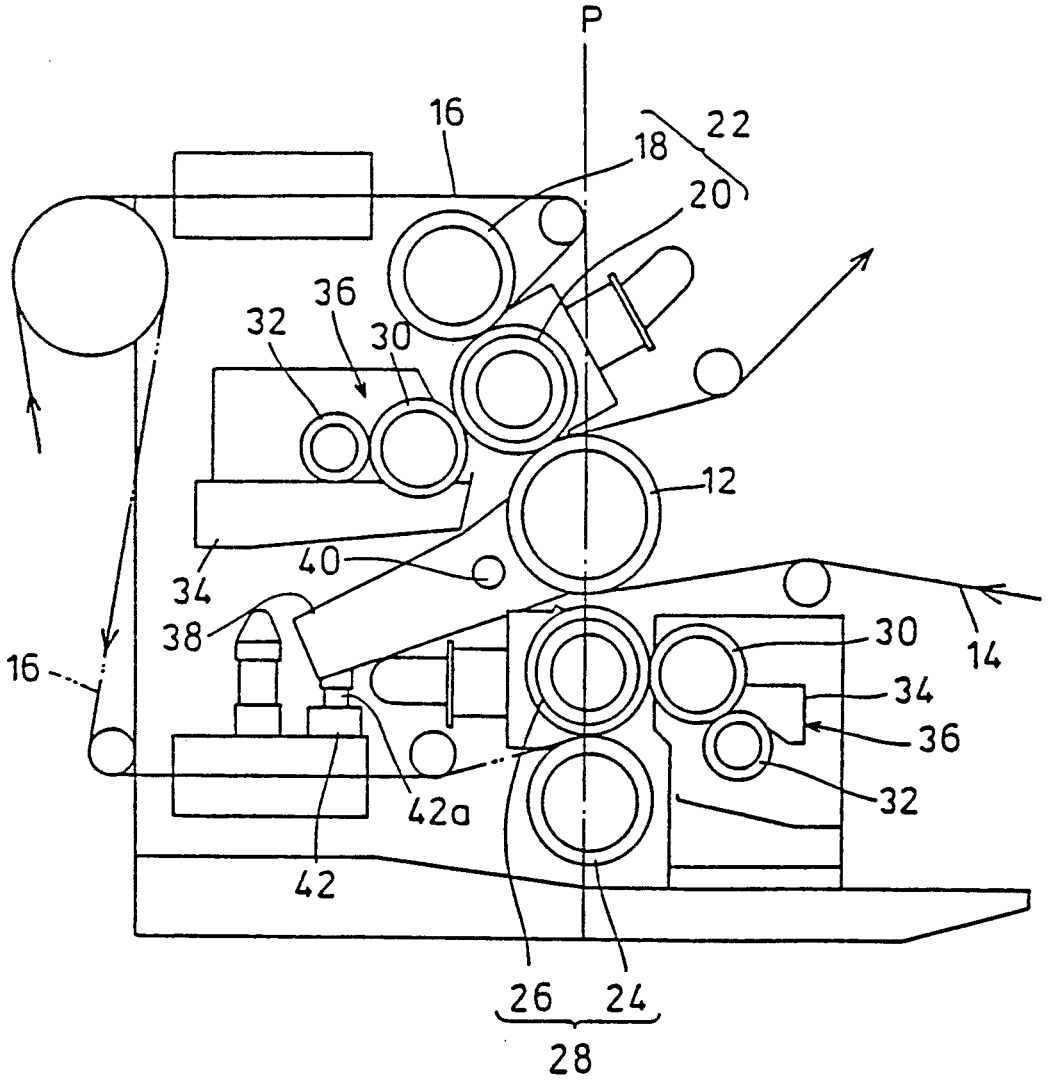
FIG. 1 schematically shows the structure of a single facer according to an embodiment of this invention.

FIG. 1 schematically shows a construction of a single facer according to this invention, wherein the reference number 12 designates a press roll for guiding a liner 14, and bonding it to the glued crests of a corrugated medium 16. Diagonally above the press roll 12 is disposed a first fluted roll unit 22 comprising a pair of fluted rolls, that is a radially outer fluted roll 18 and a radially inner fluted roll 20; whereas below the press roll 12 there is disposed a second fluted roll unit 28 also comprising a pair of fluted rolls, that is a radially outer roll 24 and a radially inner fluted roll 26.

The first fluted roll unit 22 located above the press roll 12 is disposed diagonally above the press roll 12 at the left side of the perpendicular line P passing through the axis of the press roll 12. The second fluted roll unit 28 located below the press roll 12 is disposed just below it along the perpendicular line P. In other words, the radially outer and radially inner rolls 24 and 26 constituting the second fluted roll unit 28 are vertically arranged and not disposed below the gluing mechanism 36 (to be described later) of the second fluted roll unit, so that the replacement of the radially outer and radially inner rolls of the second fluted roll unit can be facilitated and the replacement cycle time shortened.

A gluing mechanism 36 comprising a gluing roll 30, a doctor roll 32 and a glue pan 34 is disposed within the first fluted roll unit 22 and the second fluted roll unit 28, respectively. The gluing mechanism 36 disposed toward one side of the first fluted roll unit 22 scoops up the glue stored within the glue pan 34 by means of the gluing roll 30 and transfers it to the corrugating medium 16. Its basic structure is already known. For instance, as shown in FIG. 1, the gluing roll 30 and doctor roll 32 are horizontally disposed and are parallel with respect to each other at the left side of the radially inner roll 20 within the first fluted roll unit 22, with the glue pan 34 storing a predetermined amount of glue being located below these rolls 30 and 32. Since the lower end of the gluing roll 30 is immersed within the glue stored within the glue pan 34, it scoops up the glue and the glue thus attached to the surface of the gluing roll 30 is smoothed by means of the doctor roll 32 into an evenly distributed glue film. The gluing mechanism is thus constituted such that the glue film is applied to the corrugated medium 16 when the latter passes between the aforenoted radially inner roll 20 and the gluing roll 30.

On the other hand, the gluing mechanism 36 disposed toward one side of the second fluted roll unit 28 has a doctor roll 32 arranged diagonally below the gluing roll 30 which is disposed in contact with the radially inner fluted roll 26. Furthermore, the glue pan 34 is disposed toward the right (the side opposite to the fluted roll 26) of the doctor roll 32, and a portion of the glue stored within this glue pan 34 is stored within a trough portion formed at the place where the gluing roll 30 is disposed in contact with the doctor roll 32. Therefore the glue stored at this trough portion is evenly pressed between the two rolls 30 and 32 into a glue film upon the gluing roll 30.

In this basic configuration, the press roll 12 can be selectively moved relative to the first and second fluted roll units 22 and 28, and can realize the production of single-faced corrugated boards through means of the combination of the press roll 12 and the first fluted roll unit 22 or through means of the combination of the press roll 12 and the second fluted roll unit 28.

As shown in FIG. 1, the press roll 12 is pivotally supported upon one end of a lever 38, and the center of the lever 38 is supported by means of the fixed frame (not shown) by means of a pin 40. The other end of the lever 38 is connected with a piston rod 42*a* of a hydraulic cylinder 42 so as to be biased so as to rotate around the pin 40. In other words, the hydraulic cylinder 42 can be biased so as to move the piston rod 42*a* upwardly and downwardly and accordingly move the press roll 12 to a position where it can contact the radially inner roll 20 of a first fluted roll unit 22 (see FIG. 2(*a*)) or to the position where it can contact the radially inner roll 26 of the second fluted roll unit 28 (see FIG. 2(*b*)).

When the second fluted roll unit 28 is disposed vertically below the press roll 12, it has sometimes been observed that larger vibrations have occurred within the second fluted roll unit 28 than within the first fluted roll unit 22 during the production of single-faced corrugated boards.

Figure 3:
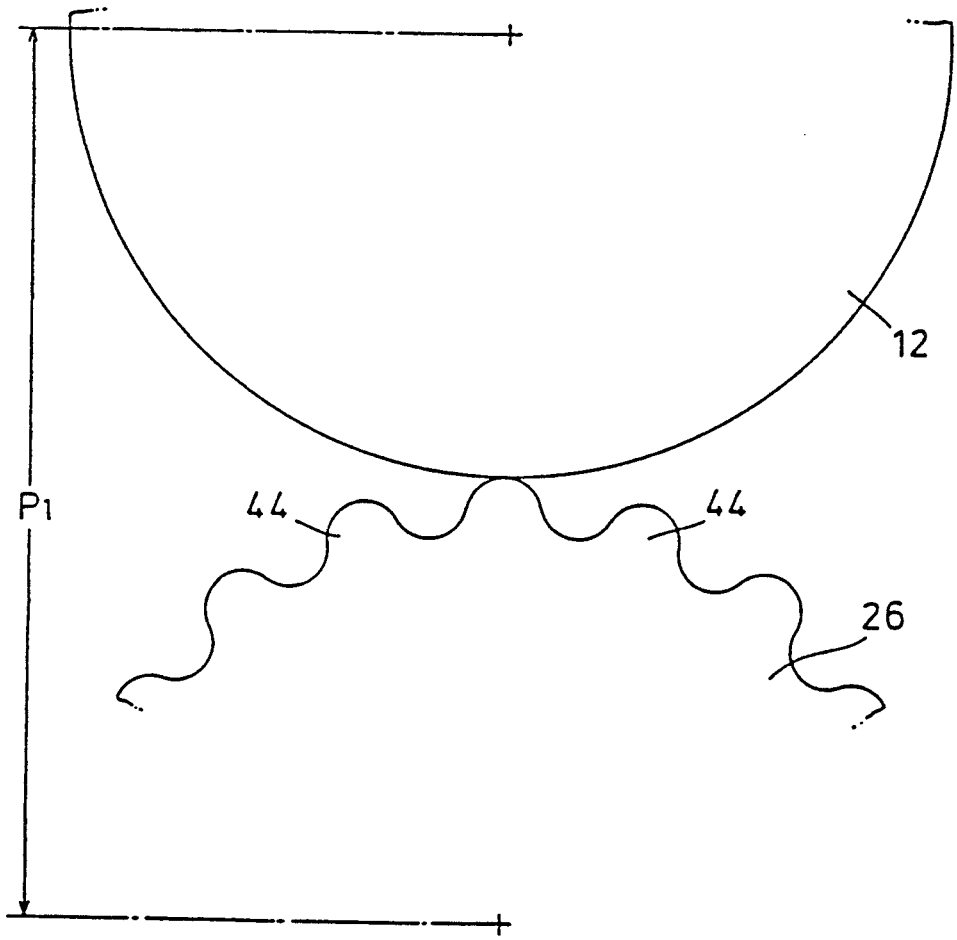
FIGS. 3(*a*) and 3(*b*) each illustrate the state of contact of the press roll with the radially inner roll of the second fluted roll unit.
Figure 3:
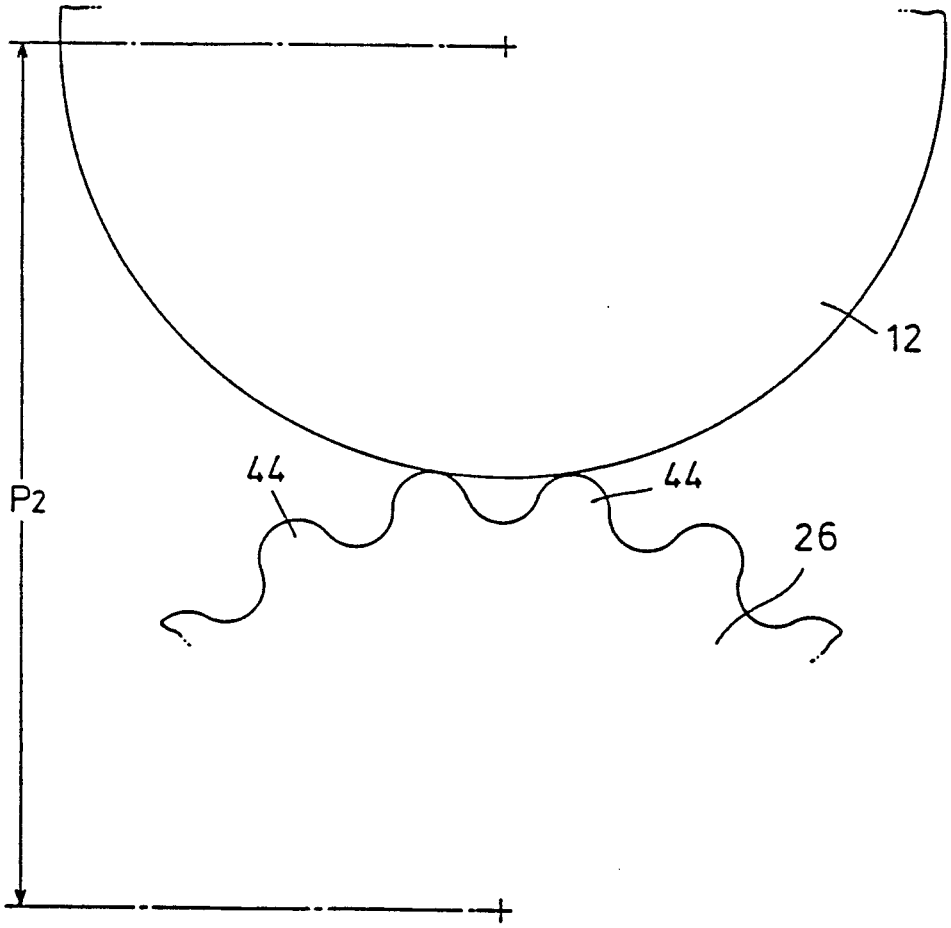

The reason why vibrations occur during the machine operation is assumed that, as shown in FIGS. 3(*a*) and 3(*b*) the center-to-center distance defined between the two rolls 12 and 26 differs ($P_1 \neq P_2$) between, for example, the state in which the crest of one flute 44 upon the radially inner roll 26 contacts the press roll 12 (FIG. 3(*a*)) and the state in which the crests of two adjacent flutes 44 contact the press roll at the same time (FIG. 3(*b*)). Furthermore, the reason why the first and second fluted roll units 22 and 28 differ in the vibration magnitude during operation is assumed that the vibrations occurring within the first fluted roll unit 22 when the same is operated are dispersed because the radially outer and radially inner rolls 18 and 20 of the first unit 22 are disposed diagonally with respect to the press roll 12, while those taking place within the second fluted roll unit 28 during operation of the same are amplified because the radially outer and radially inner rolls 24 and 26 of the second unit 28 are arranged vertically with respect to the press roll 12.

Furthermore when the fluted rolls for forming the Flute A upon the corrugated medium 16 (that is the rolls with the largest flute shape) are mounted with the second fluted roll unit 28 and operated, the corrugated medium 16 was sometimes broken upon both sides thereof in the direction perpendicular to the travelling direction. However, no breakage occurred within the corrugated medium 16 when the fluted rolls for forming, for example, flutes B, C or E, were mounted within the roll unit and operated.

Thus, a single facer of this invention is constituted such that the radially outer and radially inner rolls 24, 26 with a relatively smaller flute size are mounted within the second fluted roll unit 28 as compared with the flute size of the radially outer and radially inner rolls 18, 20 mounted within the first corrugating unit 22 when the aforenoted predetermined combination of flutes is selected for the first and second fluted roll units.

To describe the system more in detail, the combination of single-faced corrugated boards that may be produced or manufactured by means of the system of the present invention is predetermined by means of the Flutes A and E, the Flutes B and E, the Flutes C and E, and the like, wherein the flutes satisfy the size relationships with respect to one another such that Flute A > Flute C > Flute B > Flute E.

Accordingly, if the combination of Flutes A and E is selected, the radially outer and radially inner rolls 18 and 20 for forming the flute A upon the corrugated medium are mounted within the first corrugating unit 22, and those rolls 24 and 26 for forming the flute E are mounted within the second fluted roll unit 28. Furthermore, if the combination of Flutes B and E is selected, the radially outer and radially inner rolls 18 and 20 for forming the flute B are mounted within the first fluted roll unit 22, and those rolls 24 and 26 for forming the flute E are mounted within the second fluted roll unit 28. Similarly, if the combination of Flutes C and E is selected, the radially outer and radially inner rolls 18 and 20 for forming the flute C are mounted within the first fluted roll unit 22 and those rolls 24 and 26 for forming the flute E are mounted within the second fluted roll unit 28.

OPERATION OF THE PREFERRED EMBODIMENT

Next, the operation of the single facer of the preferred embodiment having the aforenoted structure according to this invention will be explained. First, the rolls having a smaller flute as compared with the flute upon the rolls mounted within the first fluted roll unit 22 are mounted within the second fluted roll unit 28 before starting the operation of the corrugating apparatus.

Figure 2:
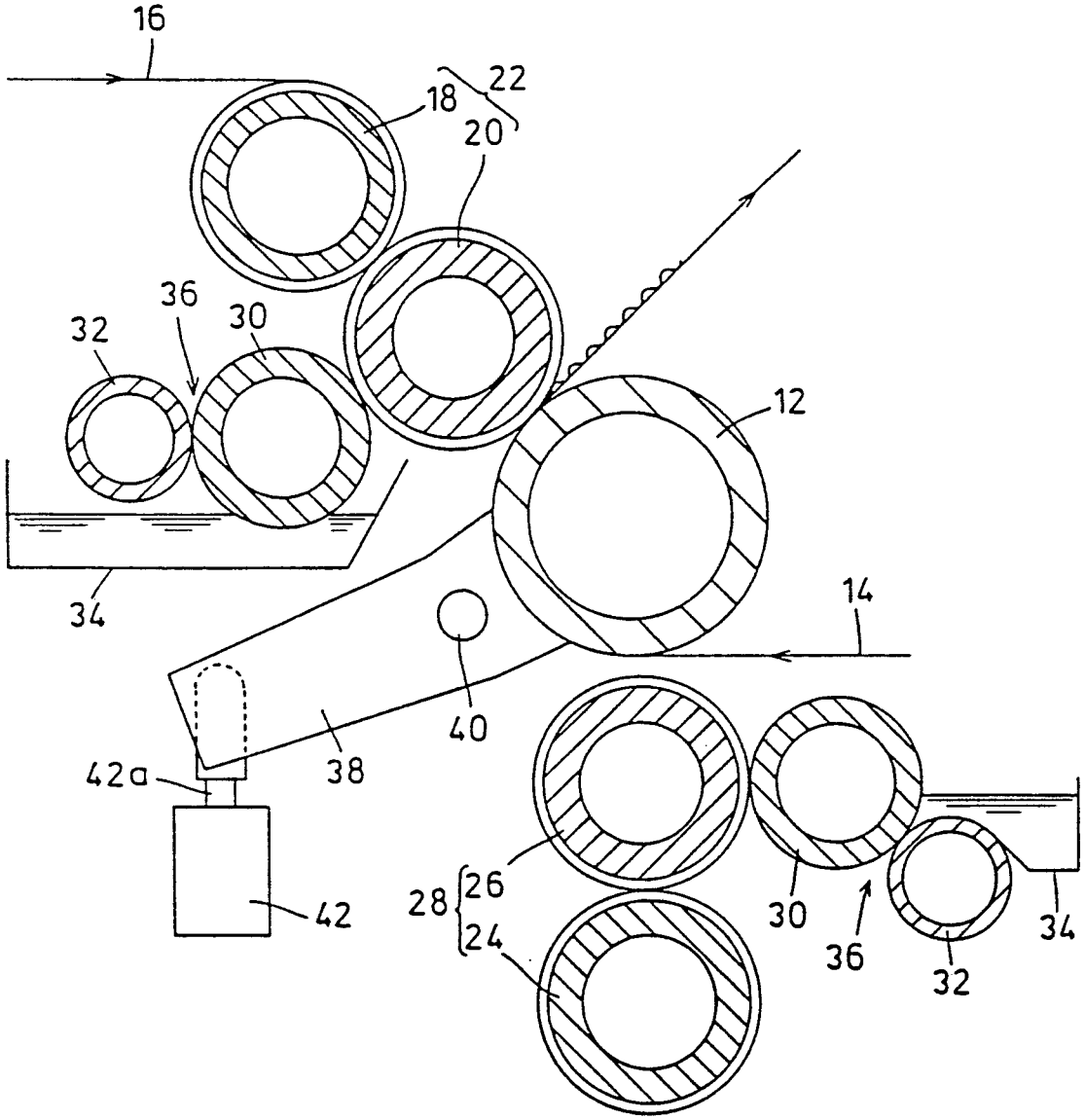
FIG. 2(*a*) shows the state of the single facer in FIG. 1 in which the first fluted roll unit is combined with the press roll so as to manufacture single-faced corrugated boards while the second fluted roll unit is on standby.
Figure 2:
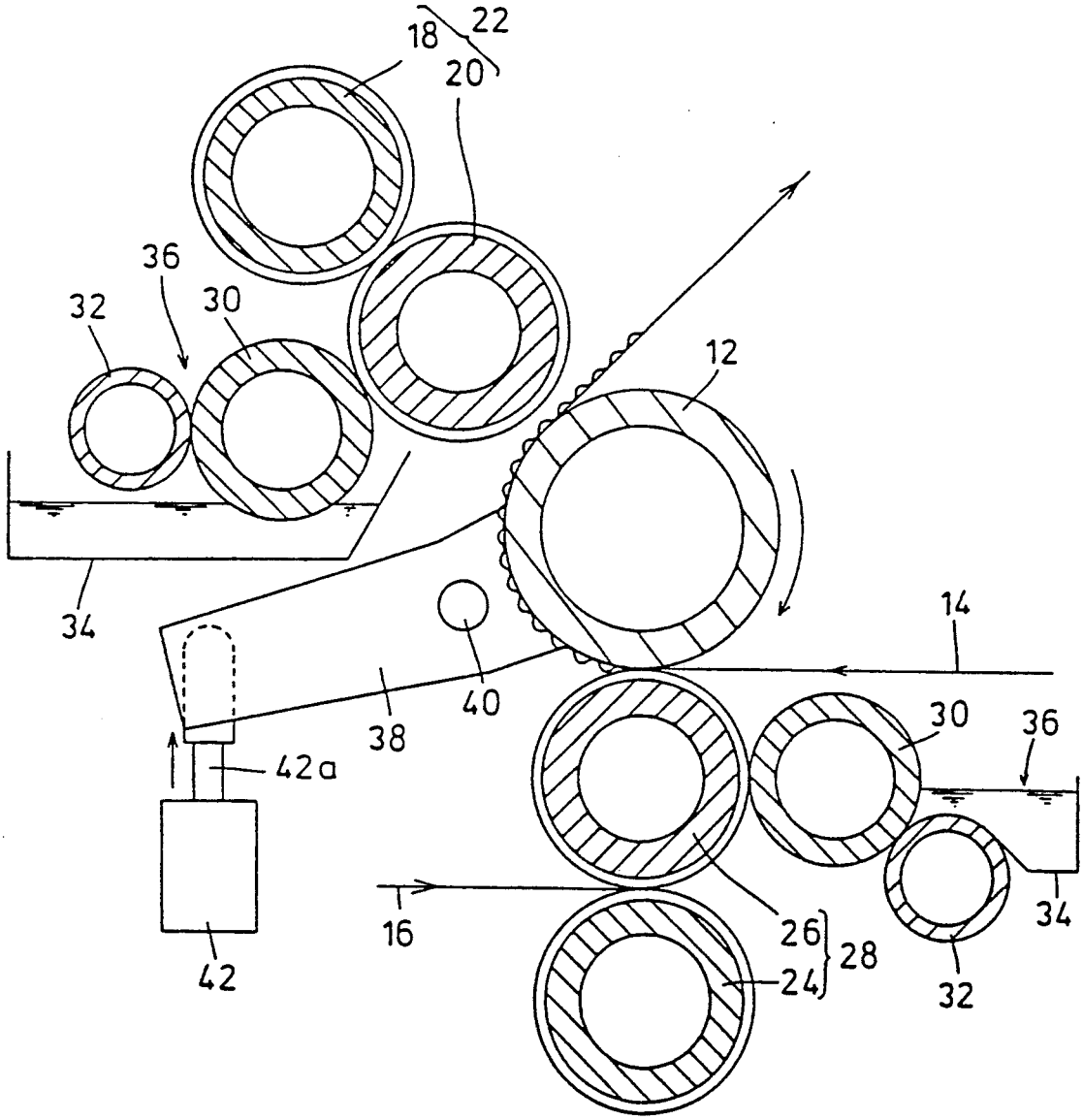

In the embodiment shown in FIGS. 1 and 2, when a single-faced corrugated board is formed using a combination of the first fluted roll unit 22 and the press roll 12, the press roll 12 is shifted to the position, as shown in FIG. 2(*a*), where it can press the liner 14 and the corrugated medium 16 thereof and to which glued crests the liner 14 is applied, against the radially inner fluted roll 20 of the first fluted roll unit 22 with an appropriate amount of pressure. If a single-faced corrugated board with a different form of corrugation (such as for example flute E) is formed after the completion of the formation of a corrugated board with a previous and different form of corrugation (such as, for example flute A), the press roll 12 is shifted to the position where it can contact the second fluted roll unit 28.

Namely, when the hydraulic cylinder 42 is biased so as to extend the piston rod 42*a*, the lever 38 rotates clockwise around the pin 40 as described above, the press roll 12 supported by means of the end of lever 38 is spaced from the radially inner roll 20 of the first fluted roll unit 22 and approaches the radially inner roll 26 of the second fluted roll unit 28. Therefore, the corrugated medium 16 is passed between the radially outer and radially inner rolls 24 and 26 of the second fluted roll unit 28 so as to form the required fluting (that is for example, the flute E) upon the corrugated medium, upon the crests of which there is applied glue means of the gluing mechanism 36, followed by pressing the medium against the liner 14 which is also supplied along the press roll 12 so as to form the single-faced corrugated board with a different form of corrugation from that previously produced by means of the first fluted roll unit 22.

It is additionally noted that the radially outer and radially inner rolls 24 and 26 having a smaller flute 44 are mounted within the second fluted roll unit 28, so there are such advantages that the vibrations of these rolls during operation can be reduced and that any breakage of the corrugated medium 16 can be effectively prevented.

Obviously, many modifications and variations of the present invention are possible in light of the above teachings. It is therefore to be understood that within the scope of the appended claims, the present invention may be practiced otherwise than as specifically described herein.

What is claimed is:

1. A single facer corrugating roll system, comprising:

a first fluted roll unit comprising a radially outer roll and a radially inner roll disposed in peripheral contact with each other;

a second fluted roll unit comprising a radially outer roll and a radially inner roll disposed in peripheral contact with each other;

a press roll interposed between said first and second fluted roll units with said first fluted roll unit being disposed substantially above said press roll while said second fluted roll unit is disposed below said press roll;

means for selectively moving said press roll into peripheral contact with one of said radially inner rolls of said first and second fluted roll units;

said press roll having a vertical plane defined therethrough said radially outer and radially inner rolls of said second fluted roll unit having their axes disposed within said vertical plane so as to be coplanar with said axis of said press roll, and wherein further, said radially outer and radially inner rolls of said second fluted roll unit have flutes of a first predetermined size; and said radially outer and radially inner rolls of said first fluted roll unit having their axes disposed within a plane which is inclined with respect to said vertical plane passing through said axes of said press roll and said radially outer and radially inner rolls of said second fluted roll unit, and wherein further, said radially outer and radially inner rolls of said first fluted roll unit have flutes of a second predetermined size which are larger than said first predetermined size of said radially outer and radially inner rolls of said second fluted roll unit, such that vibrations induced within said first and second fluted roll units are advantageously accommodated and dispersed.

2. A system as set forth in claim 1, further comprising:

means for conducting a medium-to-be-corrugated between said radially outer and radially inner rolls of said first fluted roll unit, and between said radially inner roll of said first fluted roll unit and said press roll;

means for conducting a medium-to-be-corrugated between said radially outer and radially inner rolls of said second fluted roll unit, and between said radially inner roll of said second fluted roll unit and said press roll;

means for conducting a liner between each of said radially inner rolls of said first and second fluted roll units and said press roll; and glue means disposed in peripheral contact with each one of said radially inner rolls of said first and second fluted roll units for applying glue to said corrugated medium such that said liner can be adhered to said corrugated medium for completion of the fabrication of a single-faced, lined, corrugated medium within either one of said first and second fluted roll units depending upon said selective movement of said press roll.

3. A system as set forth in claim 1, further comprising:

lever means pivotably supported upon a fixed frame;

said press roll being fixedly mounted upon one end of said lever means; and piston-cylinder means operatively connected to an opposite end of said lever means for moving said opposite end of said lever means in an upward-downward mode whereby said press roll is correspondingly moved in a downward-upward mode with respect to said radially inner rolls of said first and second fluted roll units.

4. A system as set forth in claim 2, wherein said glue means comprises:

a glue pan for storing said glue;

an applicator roll having a peripheral portion thereof in contact with said glue stored within said glue pan for receiving said glue from said glue pan, and a second peripheral portion thereof disposed in contact with a peripheral portion of said radially inner roll of either one of said first and second fluted roll units for transferring said glue to said radially inner roll of said either one of said first and second fluted roll units; and a doctor roll disposed in peripheral contact with a third peripheral portion of said applicator roll for defining a predetermined glue film upon said applicator roll.

* * * * *